US007343983B2

(12) United States Patent
Livingstone

(10) Patent No.: US 7,343,983 B2
(45) Date of Patent: Mar. 18, 2008

(54) METHOD AND APPARATUS FOR ISOLATING AND TESTING ZONES DURING REVERSE CIRCULATION DRILLING

(75) Inventor: James I. Livingstone, Calgary (CA)

(73) Assignee: Presssol Ltd., Calgary (CA)

( * ) Notice: Subject to any disclaimer, the term of this patent is extended or adjusted under 35 U.S.C. 154(b) by 164 days.

(21) Appl. No.: 10/907,849

(22) Filed: Apr. 18, 2005

(65) Prior Publication Data

US 2005/0224228 A1 Oct. 13, 2005

Related U.S. Application Data

(63) Continuation-in-part of application No. 10/906,241, filed on Feb. 10, 2005, now abandoned.

(60) Provisional application No. 60/521,051, filed on Feb. 11, 2004.

(51) Int. Cl.
*E21B 7/00* (2006.01)
*E21B 33/12* (2006.01)

(52) U.S. Cl. ..... 175/57; 175/230; 175/241; 175/48

(58) Field of Classification Search ..... 175/57, 175/230, 234, 241, 232, 317, 318, 48
See application file for complete search history.

(56) References Cited

U.S. PATENT DOCUMENTS 2,609,836 A 9/1952 Knox
3,075,589 A 1/1963 Grable et al.
3,416,618 A 12/1968 Kunnemann (Continued)

FOREIGN PATENT DOCUMENTS

CA 1325969 10/1987

(Continued)

OTHER PUBLICATIONS

Underbalanced Drilling; Nowsco.

(Continued)

*Primary Examiner*—Jennifer H Gay
*Assistant Examiner*—Robert E Fuller
(74) *Attorney, Agent, or Firm*—Bennett Jones LLP

(57) ABSTRACT

A zone isolating and testing apparatus comprising an isolation tool and a downhole flow control means and a method of using such apparatus. The zone isolating and testing apparatus is particularly useful for testing zones during reverse circulation drilling using concentric drill string such as concentric drill pipe or concentric coiled tubing. The isolation tool of the zone isolating and testing apparatus comprises an expandable packer means and is adapted to connect to concentric drill string near the drilling means and be in fluid communication with the concentric drill string. The downhole flow control means of the zone isolating and testing apparatus comprises at least two valves, one for closing off the annular conduit between the inner tube and outer tube of the concentric drill string and the other for closing off the inner conduit of the inner tube. The downhole flow control means is also adapted to connect to concentric drill string near the drilling means and be in fluid communication with the concentric drill string. During testing, the isolation tool seals off the annular passage between the concentric drill string and the walls of the wellbore and the downhole flow control means seals off either the annular conduit or the inner conduit of the concentric drill string.

17 Claims, 7 Drawing Sheets

U.S. PATENT DOCUMENTS 3,770,006 A 11/1973 Sexton et al.
3,792,429 A 2/1974 Patton et al.
3,795,283 A 3/1974 Oughton
3,920,090 A 11/1975 McQueen et al.
4,055,224 A 10/1977 Wallers
4,100,528 A 7/1978 Bernard et al.
4,219,087 A 8/1980 Johnson
4,243,252 A 1/1981 Johnson
4,321,974 A 3/1982 Klemm
4,391,328 A 7/1983 Aumann
4,431,069 A 2/1984 Dickinson, III et al.
4,461,448 A 7/1984 Huey et al.
4,463,814 A 8/1984 Horstmeyer et al.
4,509,606 A 4/1985 Willis
4,534,426 A 8/1985 Hooper
4,647,002 A 3/1987 Crutchfield
4,671,359 A 6/1987 Renfro
4,681,164 A 7/1987 Stacks
4,682,661 A * 7/1987 Hughes et al. ..... 175/215
4,705,119 A 11/1987 Kostylev et al.
4,709,768 A 12/1987 Kostylev et al.
4,718,503 A 1/1988 Stewart
4,739,844 A 4/1988 Farris et al.
4,744,420 A 5/1988 Patterson et al.
4,790,391 A 12/1988 Hamamura et al.
4,832,126 A 5/1989 Roche
5,006,046 A 4/1991 Buckman et al.
5,020,611 A 6/1991 Morgan et al.
5,033,545 A 7/1991 Sudol
5,068,842 A 11/1991 Naito
5,125,464 A * 6/1992 Sabatier ..... 175/135
5,174,394 A 12/1992 Fischer et al.
5,178,223 A 1/1993 Smet
5,199,515 A 4/1993 Sinclair et al.
5,236,036 A 8/1993 Ungemach et al.
5,285,204 A 2/1994 Sas-Jaworsky
5,348,097 A 9/1994 Giannesini et al.
5,396,966 A 3/1995 Roos, Jr. et al.
5,411,105 A 5/1995 Gray
5,435,395 A 7/1995 Connell
5,513,528 A 5/1996 Holenka et al.
5,575,451 A 11/1996 Colvin et al.
5,638,904 A 6/1997 Misselbrook et al.
5,720,356 A 2/1998 Gardes
5,881,813 A 3/1999 Brannon et al.
5,890,540 A 4/1999 Pia et al.
5,892,460 A 4/1999 Jerabek et al.
6,015,015 A 1/2000 Luft et al.
6,047,784 A 4/2000 Dorel
6,065,550 A 5/2000 Gardes
6,109,370 A 8/2000 Gray
6,158,531 A 12/2000 Vail, III
6,189,617 B1 2/2001 Sorhus et al.
6,192,985 B1 2/2001 Hinkel et al.
6,196,336 B1 3/2001 Fincher et al.
6,209,663 B1 4/2001 Hosie
6,209,665 B1 4/2001 Holte
6,213,201 B1 4/2001 Renkis
6,250,383 B1 6/2001 Patel
6,263,987 B1 7/2001 Vail, III
6,325,159 B1 12/2001 Peterman et al.
6,359,438 B1 3/2002 Bittar
6,377,050 B1 4/2002 Chemali et al.
6,394,197 B1 5/2002 Holte
6,405,809 B2 6/2002 Patel et al.
6,457,540 B2 10/2002 Gardes
6,481,501 B2 11/2002 Chavez et al.
6,497,290 B1 * 12/2002 Misselbrook et al. ..... 166/384
6,668,933 B2 12/2003 Kent
6,745,855 B2 6/2004 Gardes
6,918,440 B2 * 7/2005 Garcia-Soule et al. ..... 166/142
7,066,283 B2 * 6/2006 Livingstone ..... 175/61
7,152,700 B2 * 12/2006 Church et al. ..... 175/320
7,204,327 B2 * 4/2007 Livingstone ..... 175/318
2002/0000332 A1 1/2002 Merecka et al.
2003/0141111 A1 7/2003 Pia
2003/0150621 A1 8/2003 Pia
2005/0103527 A1 * 5/2005 Church et al. ..... 175/62
2005/0178586 A1 * 8/2005 Livingstone ..... 175/317

FOREIGN PATENT DOCUMENTS

EP 0787886 5/1997
EP 1 245 783 2/2002
FR 2597150 4/1986
GB 2368079 10/2000
WO WO 97/05361 2/1997
WO WO 97/35093 9/1997
WO WO 00/57019 9/2000
WO WO 01/90528 11/2001
WO WO 02/10549 2/2002

OTHER PUBLICATIONS

Nowsco/Downhole Systems: "Test, Treat, Test System Using a Concentric Coiled Tubing/DST Package": Hoyer, Fried & Sask.
BlackMax Downhole Tools; An NQL Drilling Tools Inc. Company; Electro Magnetic Measurement While Drilling; Oil & Gas Application; EM=MWD.
Logging While Drilling; http://www.odp.tamu.edu/publications/196_IR/chap_2/c2_.htm.
Drilling and Formation Evaluation; Baker Hughes; www.bakerhughes.com/bakerhughes/products/well.htm.
On Trak MWD System; Baker Hughes; www.bakerhughes.com/inteq/evaluation/ontrak/index.htm.
PressTEQ Application Examples; Baker Hughes; www.bakerhughes.com/inteq/D&P/pressure/index.htm.
Thruster Drilling System; Baker Hughes; www.bakerhughes.com/inteq/Drilling/thruster/index.htm.
Coiled Tubing; Baker Hughes; Baker Oil Tools Coiled Tubing Solutions; www.bakerhughes.com/bot/coiled_tubing/index/htm.
COLT Coil Tubing Drilling Bottom Hole Assembly; Antech Special Engineering Products; Coiled Tubing Downhole Tools.
U.S. Appl. No. 10/644,749, filed Aug. 21, 2003 by James Livingstone.

* cited by examiner

METHOD AND APPARATUS FOR ISOLATING AND TESTING ZONES DURING REVERSE CIRCULATION DRILLING

This application is a continuation-in-part of U.S. application Ser. No. 10/906,241, filed Feb. 11, 2005 now abandoned, which claims the benefit of U.S. Provisional Application No. 60/521,051, filed Feb. 11, 2004.

FIELD OF USE

The present invention relates to an apparatus and method for isolating and testing individual zones in a vertical, directional or horizontal wellbore during drilling. More particularly, the present invention relates to a zone isolating and testing apparatus and method of use thereof to allow testing of isolated zones for flow of hydrocarbons, formation fluids and/or drill cuttings during vertical, horizontal or directional reverse circulation drilling of wellbores using concentric drill pipe, concentric coiled tubing, or the like.

BACKGROUND OF THE INVENTION

The oil and gas industry uses various methods to test the productivity of wells prior to completing a well (see, for example, U.S. Pat. No. 4,898,236). After drilling operations have been completed and a well has been drilled to total depth, or prior to reaching total depth in the case of multi-zoned discoveries, it is common to test the zone to estimate future production of oil and gas. Current technologies used for testing reservoirs such as drill stem testing (DST) are often too expensive to test multi-zone reservoirs, particularly at shallow depths. Furthermore, isolating and testing zones using conventional packer technology can be slow, expensive and sometimes difficult to set and then release.

Traditionally the DST process involves flowing a well through a length of drill pipe reinserted through the static drilling fluid. The bottom of the pipe will attach to a tool or device with openings through which fluid can enter. This perforated section is placed across an anticipated producing section of the formation and sealed off with packers, frequently a pair of packers placed above and below the part of the formation being tested. This packing off technique permits an operator to test only an isolated section or cumulative section.

The present invention allows a fast, safe and economic way to isolate and test zones during reverse circulation drilling by using the already inserted concentric drill string used during drilling. This alleviates the need to first remove the drill string used for drilling and then reinsert a length of drill pipe or coiled tubing for testing.

SUMMARY OF THE INVENTION

A zone isolating and testing apparatus comprising an isolation tool and a downhole flow control means and a method of using such apparatus is disclosed. The zone isolating and testing apparatus is particularly useful for testing zones during reverse circulation drilling using concentric drill string, e.g., concentric drill pipe, concentric coiled tubing and the like, said concentric drill string comprising an inner tube and an outer tube forming an annular conduit therebetween. The zone isolating and testing apparatus is operably connected to a concentric drill string so as to be in fluid communication with both the inner tube and the annular conduit of the concentric drill string.

The isolation tool of the zone isolating and testing apparatus comprises a center tube and an outer casing, forming an annular passage therebetween. The isolation tool further comprises an expandable packer means surrounding the outer circumference of the outer casing. The isolation tool is adapted to connect to the bottom of a piece of concentric drill string and is generally positioned near the drilling means.

When the isolation tool is connected to the concentric drill string, the center tube of the isolation tool is in fluids communication with the inner tube of the concentric drill pipe and the annular passage of the isolation tool is in fluid communication with the annular conduit of the concentric drill string.

The packer means of the isolation tool can assume two functional positions. When the packer means is in the expanded position, the isolation tool is in the "closed position" and when the packer means is in the contracted position the isolation tool is in the "open position". In a preferred embodiment, the expansion of the packer means is controlled by an electric current for quicker opening and closing of the isolation tool.

It is understood in the art that the area of the zone tested will be dictated by the distance the isolation tool is placed away from the drilling means. In some instances where the bands of the pay zones are known to be quite broad the isolation tool and the drilling means can be separated from one another by several joints of concentric drill string.

The downhole flow control means of the zone isolating and testing apparatus also comprises a center tube and an outer casing forming an annular passage therebetween. The downhole flow control means is attached either directly to the isolation tool or to an intervening piece of concentric drill string in such a fashion so as to be in fluid communication with both passageways of the concentric drill string. The downhole flow control means further comprises two valves, one for closing off its annular passage, thus closing off the annular conduit of the concentric drill string and the other for closing off the inner passage of its center tube, thereby closing off the inner conduit of the inner tube of the concentric drill string.

During the drilling process, the isolation tool is in the open position, i.e. the packer means is contracted. When the tool is in the open position it does not significantly restrict the flow of hydrocarbons through the annulus formed between the wellbore and the concentric drill string, as the outside diameter of the isolation tool when in the open position is preferably equal to or less than the outside diameter of the concentric drill string. However, it is understood that the outside diameter of the open isolation tool can also be less than or greater than the outside diameter of the concentric drill string and still not significantly restrict the flow of hydrocarbons.

The downhole flow control means is also in the complete open position during drilling, i.e., both valves are open. This allows drilling fluid to be pumped down either the annular conduit or inner conduit of the inner tube of the concentric drill string and exhaust drilling fluid and drill cuttings to be removed through the other of said annular conduit or inner conduit.

However, when testing is required during the reverse circulation drilling process, the isolation tool is in the closed position, i.e. the packer means expands to abut the adjacent wellbore walls. Further, one of the two valves of the downhole flow control means is also in the closed position. Which valve will be closed is dependent upon whether drilling fluid is being pumped through the annular conduit or the inner conduit. For example, if drilling fluid were being pumped down the annular conduit then during testing the annular passage valve would be closed during testing.

Thus, during testing, the zone of the wellbore below the isolation tool is shut off or isolated from the portion of the wellbore above the tool as the expanded packer means will not allow hydrocarbons to flow passed it. The materials present in the isolated zone can then flow through either the annular conduit or inner conduit of the concentric drill string to the surface of the well for testing.

The disclosed invention has one or more of the following advantages over conventional isolation packer technology and drill stem testing:

- when drilling vertical, directional, and/or horizontal wellbores, individual zones can be isolated and tested much quicker and cheaper without having to interrupt drilling for extended periods of time;
- open hole testing provides very valuable production data;
- zones which may otherwise be damaged by testing fluids when using drill stem testing can now be tested without damage as testing fluids are not necessary;
- easier to measure the flow of formation fluids into a zone;
- decisions on well stimulation can be made while the well is being drilled; and
- more accurate information on reservoir pressure, temperature, flow rate etc. can be obtained from individual zones.

DETAILED DESCRIPTION OF THE PREFERRED EMBODIMENT

A zone isolating and testing apparatus comprising an isolation tool and a downhole flow control means and method of using such apparatus will now be described with reference to the following preferred embodiment.

Figure 1:
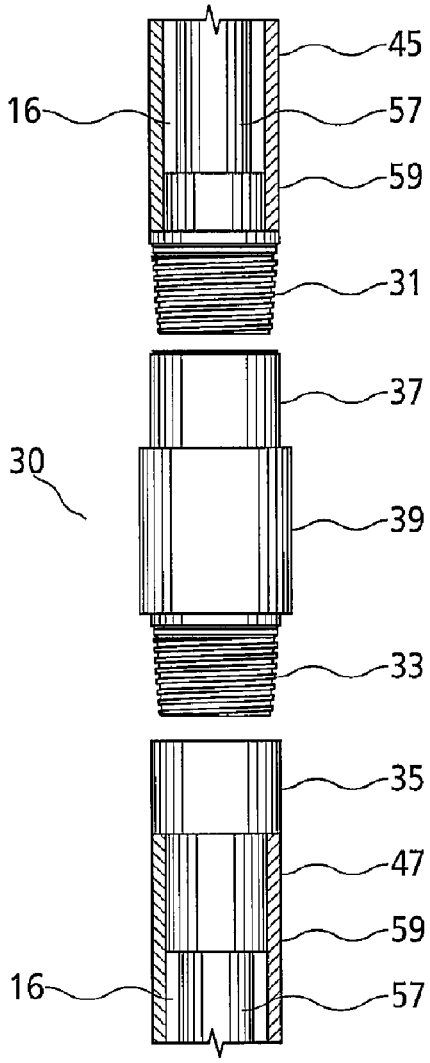
FIG. 1 is a schematic of one embodiment of the isolation tool of the invention.

FIG. 1 schematically illustrates the isolation tool 30 of the zone isolating and testing apparatus and means for attaching the isolation tool 30 between two pieces of concentric drill string 45 and 47. Concentric drill string 45 and 47 both comprise an inner tube 57 and an outer tube 59. Concentric drill string is designed such that at one end of concentric drill string is a threaded pin end and at the other end is a threaded box end. Thus, pieces of concentric drill string can be connected end to end by screwing the threaded pin end of the new piece of concentric drill string to be added into the box end of the drill string below.

As can be seen in FIG. 1, concentric drill string 45 has threaded pin end 31 at its bottom end and concentric drill string 47 has threaded box end 35 at its top end. Isolation tool 30 is adapted to be inserted between concentric drill string 45 and 47 by means of threaded box end 37 and threaded pin end 33. Thus, threaded pin end 31 of concentric drill string 45 screws into threaded box end 37 and threaded pin end 33 screws into threaded box end 35 of concentric drill string 47.

Figure 6:
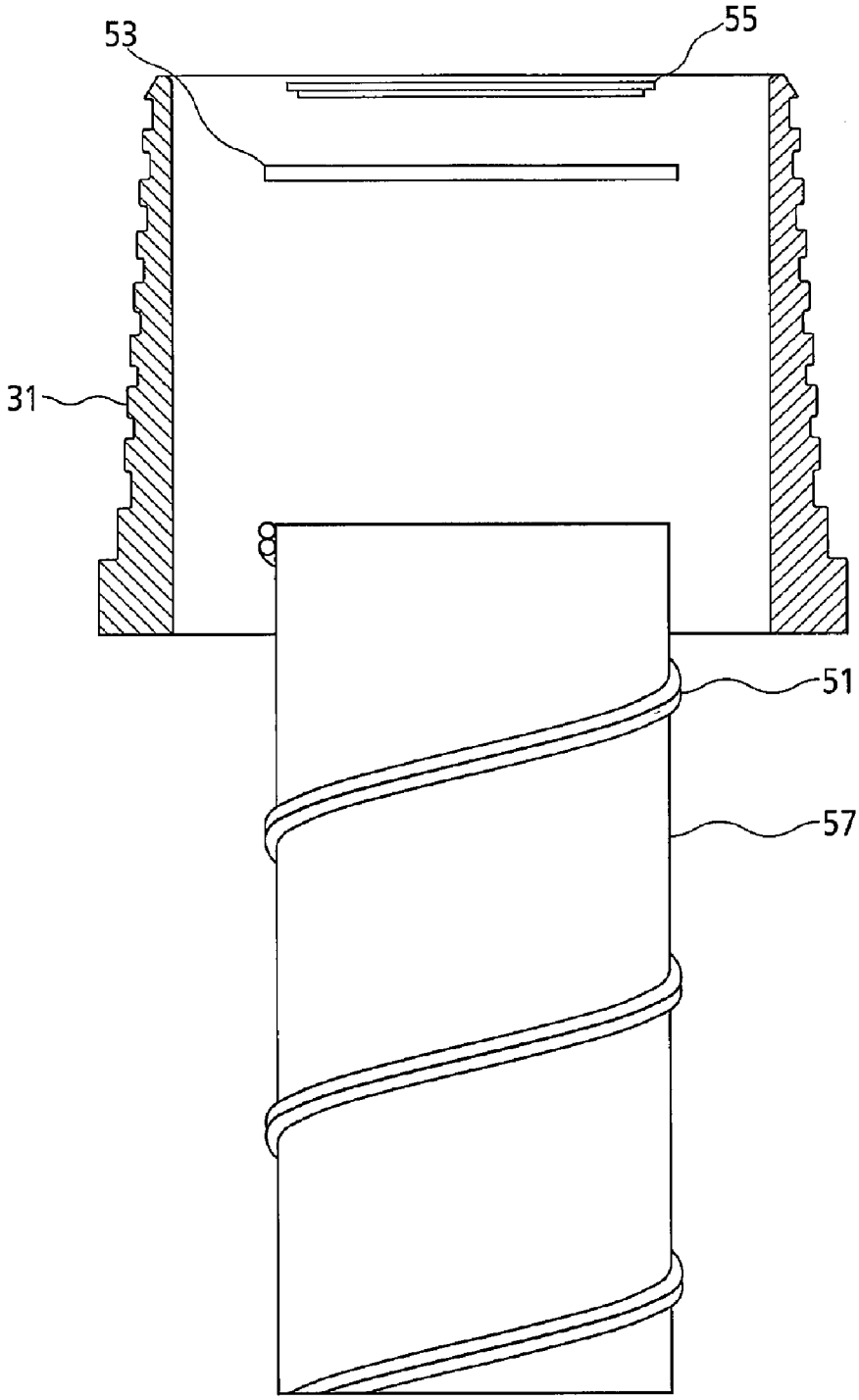
FIG. 6 is a schematic of one embodiment of the inner drill string of concentric drill string of the invention.

Isolation tool 30 further comprises packer means 39. Packer means 39 can be expanded or contracted by any means known in the art, for example, by means of an electric current flow path as shown in FIG. 6. In another embodiment, the packer means comprises an inflatable ring which can be inflated and deflated by pumping various types of fluid into and out of the ring.

Figure 2:
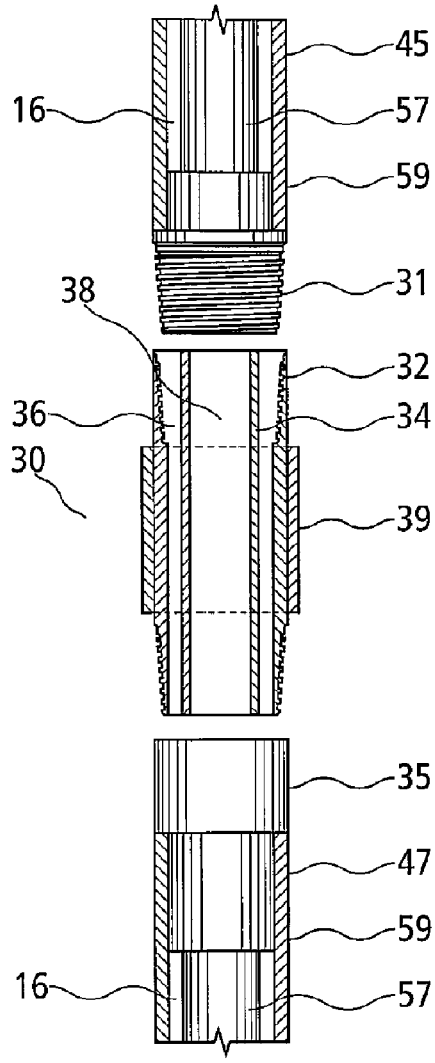
FIG. 2 is a cross-sectional view of the isolation tool shown in FIG. 1.

With reference to FIG. 2, isolation cementing tool 30 further comprises a center tube 34, an outer casing 32, an annular passage 36 between the center tube and outer casing, an inner passage 38, and a packer means 39 surrounding said outer casing 32. When isolation cementing tool 30 is inserted between concentric drill string 45 and 47, the center tube 34 of the isolation cementing tool 30 is in fluid communication with the inner tube 57 of the concentric drill string 45 and 47 and the annular passage 36 of the isolation cementing tool 30 is in fluid communication with the annular conduit 16 of the concentric drill string 45 and 47.

Figure 3A:
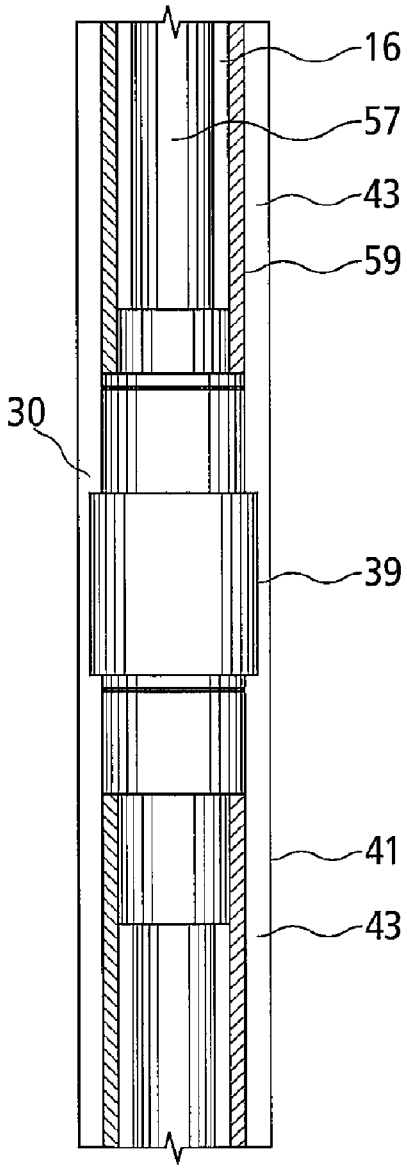
FIGS. 3*a* and 3*b* are schematics of the isolation tool in the open and closed position, respectively.
Figure 3B:
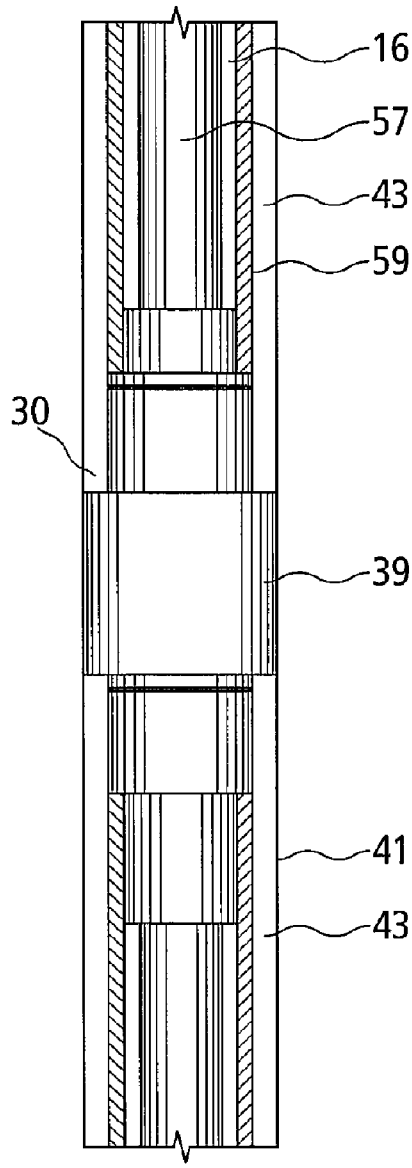

FIGS. 3*a* and 3*b* schematically illustrate the isolation tool 30 attached to the concentric drill string in the open and closed position, respectively. During drilling the isolation tool 30 is in the open position and during testing it is in the closed position.

When packer means 39 is contracted or deflated as shown in FIG. 3*a*, the isolation tool 30 is in the open position and hydrocarbons can flow freely through the wellbore annulus 43 formed between the outer wall of the concentric drill string and the wellbore wall 41. When packer means 39 is expanded or inflated as shown in FIG. 3*b*, the packer means 39 is forced against wellbore wall 41 thereby closing annulus 43 to hydrocarbon movement above or below the packer means 39. Thus, the testing region below the packer is isolated from the surface of the wellbore.

Figure 4:
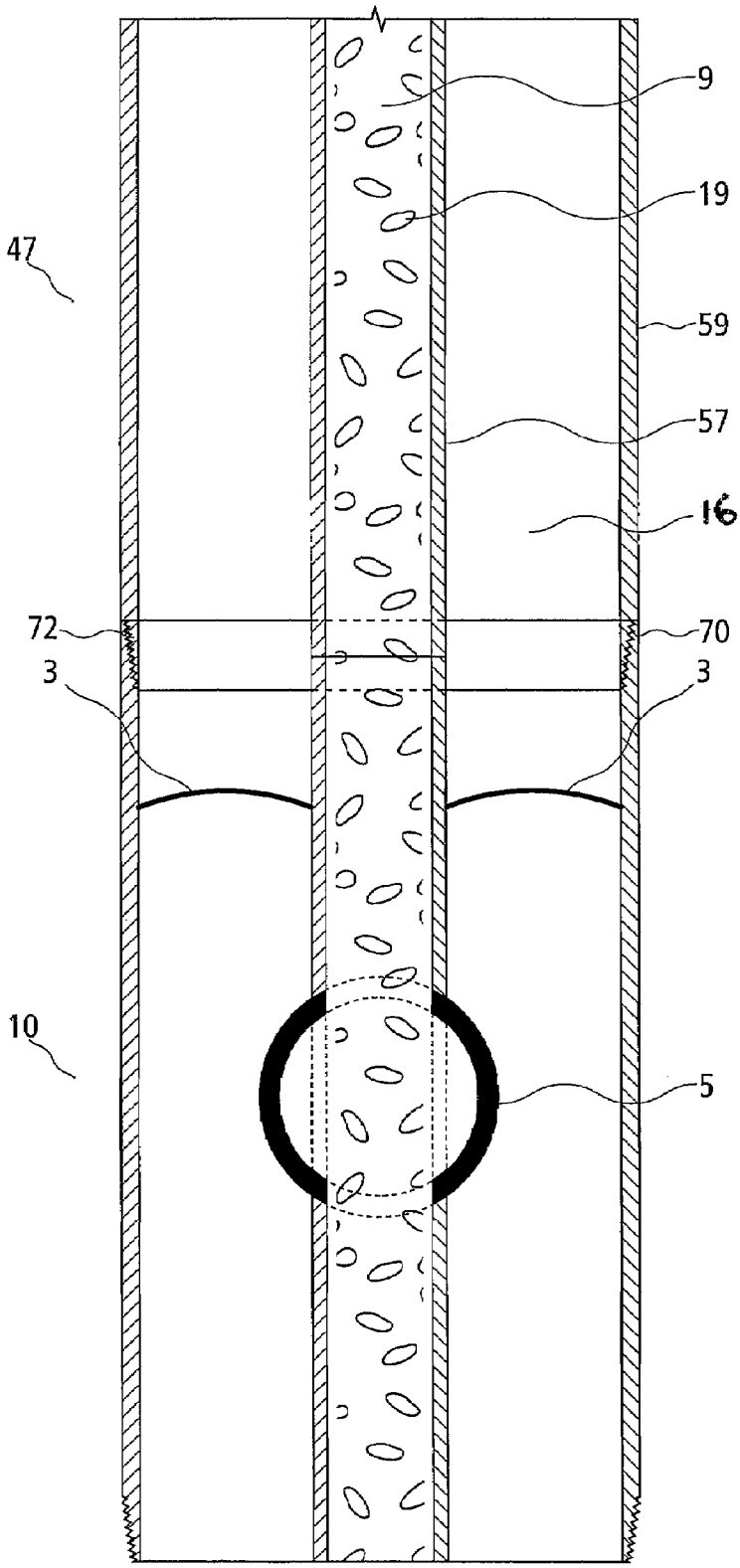
FIG. 4 is a cross-section view of the downhole blow out preventor.

In order to test for hydrocarbon flow, formation fluids, drill cuttings and the like present in the testing zone, the isolation tool is used in conjunction with a downhole flow control means or downhole blow out preventor (downhole BOP) as shown in FIG. 4. In FIG. 4, downhole BOP 10 is shown in cross-section attached to the lower end of concentric drill string 47 by threaded pin end 72 of concentric drill string 47 screwing into threaded box end 70 of downhole BOP 10.

In this embodiment, downhole BOP 10 comprises two valve means 3 and 5 for shutting off the flow of drilling fluid, exhausted drilling fluid, drill cuttings and/or hydrocarbons through one or the other of the annular conduit 16 formed between inner tube 57 and outer tube 59 of concentric drill string 47 and inner conduit 9 of inner tube 57. It is understood that other downhole flow control means can also be used, for example, the downhole flow control means as described in U.S. Patent Applications Publication Nos. 20030155156 and 20030173088, incorporated herein by reference.

Thus, in one embodiment of the invention, the isolation tool 30 and the downhole BOP 10 of the zone isolating and testing apparatus can be separated by a single joint of varying lengths of concentric drill string 47. However, it is understood that in some instances the isolation tool and downhole BOP can be directly threaded or connected by other connection means to each other. Further, it can be appreciated that the orientation of the two components is not critical; in some instances it may be desirable to have the downhole BOP attached to the bottom of the concentric drill string first and the isolation tool connected either directly or by means of one or more joints of concentric drill string below the downhole BOP.

It is understood that the drilling means (not shown) can be either directly attached to the bottom of the downhole flow control means, the isolation tool, other downhole tools or an intervening joint of concentric drill string. In general, however, the drilling means is attached to the last in the series of downhole tools.

During reverse circulation drilling with concentric drill string, both valves 3 and 5 of the downhole BOP 10 are in the open position (not shown). In one embodiment, drilling fluid is pumped from surface equipment through the annular conduit 16 of the concentric drill string and exhausted drilling fluid, drill cuttings and/or hydrocarbons 19 flow through the inner conduit 9 to the surface of the wellbore. It is understood that drilling fluid could also be pumped from surface through the inner conduit 9 and exhausted drilling fluid, drill cuttings and/or hydrocarbons removed through the annular conduit 16.

When drilling is stopped for testing, the isolation tool 30, which is located at or near the downhole BOP, is put in the closed position as shown in FIG. 3*b* to isolate the testing region below the packer means. In the instance where drilling fluid is being pumped down the annular conduit 16 and exhausted drilling fluid, drill cuttings and/or hydrocarbons flow through the inner conduit 9 to the surface of the wellbore, valve means 3 of the downhole BOP 10 is also put in the closed position as shown in FIG. 4, as no fluids are being flowed from surface equipment during testing.

Valve means 5, however, remains in the open position as shown in FIG. 4 thereby allowing hydrocarbons, formation fluids and/or drill cuttings (collectively referred to as reference 19) present in the isolated zone to flow to surface. Well flow test equipment known in the art will be able to determine the hydrocarbon content of the isolated testing area. Optionally, a surface blow out preventor (surface BOP, not shown) is provided to shut off the flow of hydrocarbon from the annulus formed between the concentric drill string and the wellbore walls that may be present in the zone above the packer means.

Figure 5:
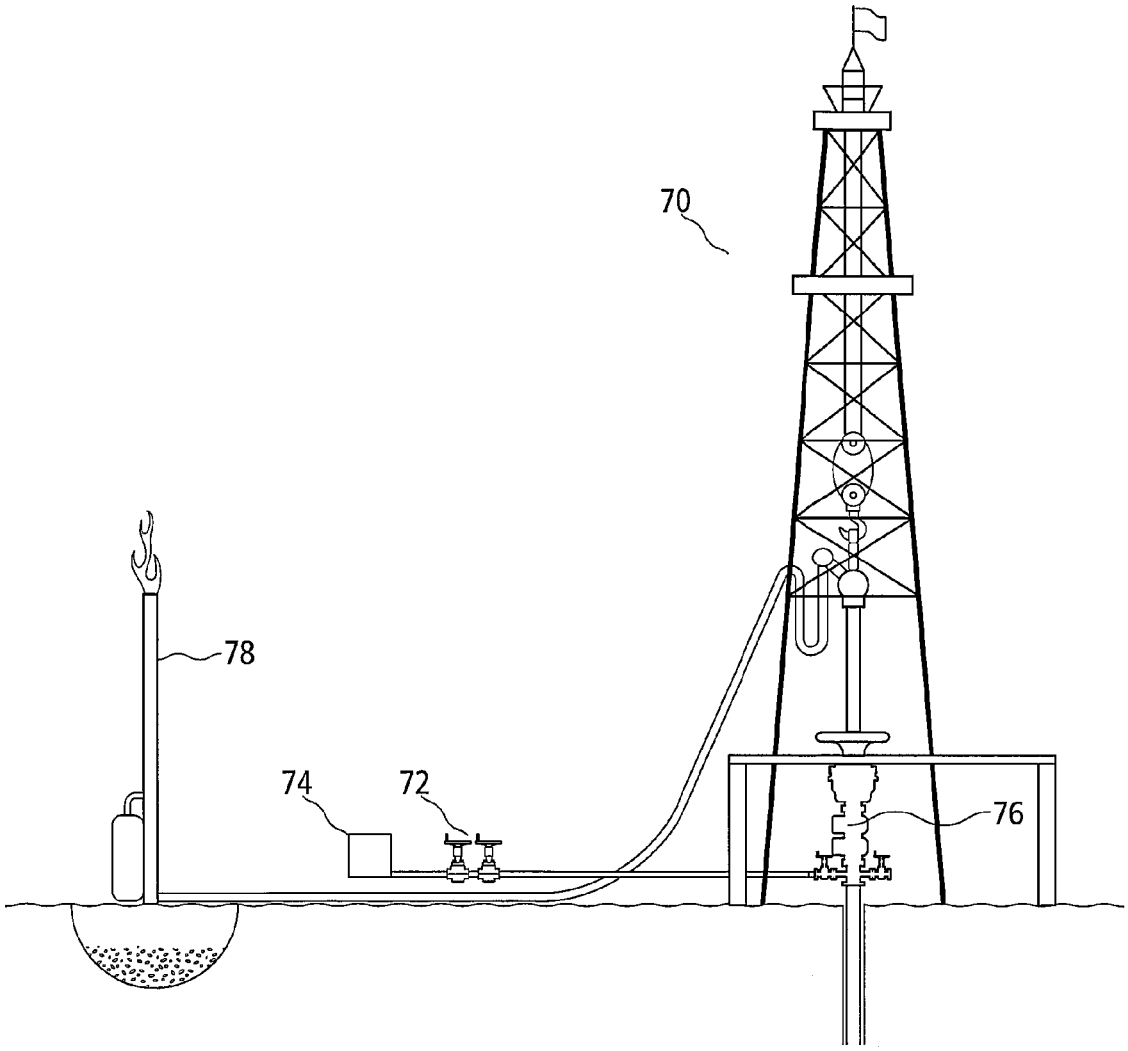
FIG. 5 is a schematic of the surface drilling and testing equipment used in the invention.

FIG. 5 schematically shows the surface equipment used during drilling and testing. Drilling rig 70 is equipped with well testing equipment 74. The hydrocarbons in the test region flow through the inner conduit of the inner tube of the concentric drill string and then through the choke manifold system as shown in 72. Well flow test equipment can also be located at the end of blewie line 78. Surface BOP 76 ensures that there is no escape of hydrocarbons to the surface through the annulus formed between the concentric drill string and the wellbore walls.

The isolation tool is preferably powered by an electric current for quicker opening and closing operations. FIG. 6 is a schematic of a portion of concentric drill string having threaded pin end 31 at one end. The outer tube has been removed to reveal inner tube 57, which is preferably made of a rubber type material, rubber/steel, fiberglass or composite material, capable of withstanding the forces and pressures of the drilling operations. Inner tube 57 further comprises electrical wires 51 that allow the flow of the electric current. Wire coils 53 and 55 are compressed in each end of the concentric drill string when two pieces of concentric drill string are torqued (screwed) together. This provides the electric current to operate the isolation tool, e.g., to expand or contract the packer means as needed.

Other means of operating the isolation tool could include fiber optic cables, radio frequency and electric magnetic forces. When using concentric coiled tubing the isolation tool can be operated using small diameter capillary tubes which transmit hydraulic or pneumatic pressure to an actuator at or near the tool.

Figure 7:
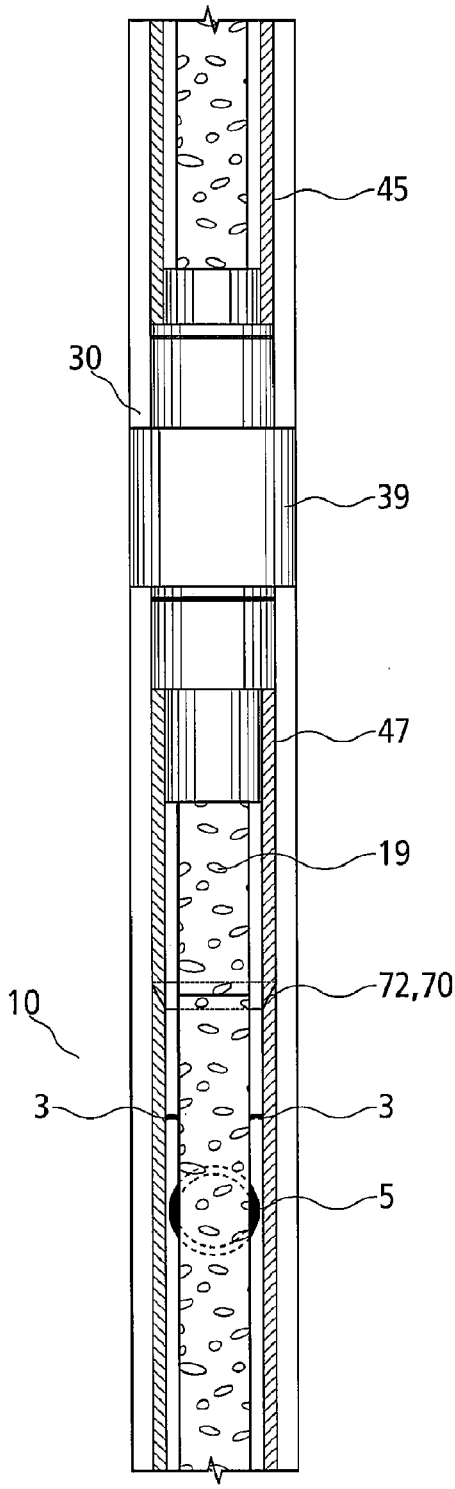
FIG. 7 is a cross-sectional view of one embodiment of the zone isolating and testing apparatus typically used with concentric drill pipe.

FIG. 7 shows a cross-section of one embodiment of the assembled zone isolating and testing apparatus of the present invention, which is typically used with concentric drill pipe. In this embodiment, the isolation tool 30 and the downhole BOP 10 are spatially separated by means of a single joint of varying lengths of concentric drill pipe 47. Typically, the drilling means (not shown) is attached either directly to the downhole BOP 10 or to other downhole tools that can be attached to the downhole BOP. It may be desirable, however, particularly in instances where the bands of the pay zones are known to be quite broad (i.e., 40 ft or greater), to have the isolation tool and the drilling means separated even further by additional joints of concentric drill string.

Figure 8:
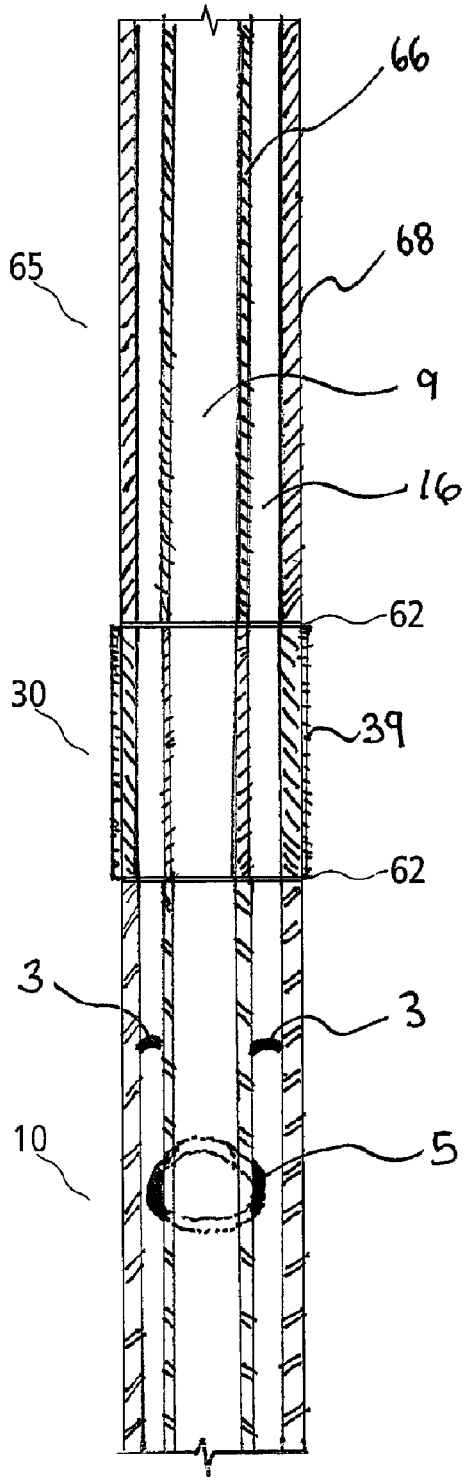
FIG. 8 is a cross-sectional view of one embodiment of the zone isolating and testing apparatus typically used with concentric coiled tubing.

FIG. 8 shows another embodiment of the assembled zone isolating and testing apparatus, which is typically used when the concentric drill string comprises a continuous length of concentric coiled tubing 65 having a continuous length of inner coiled tubing 66 and a continuous length of outer coiled tubing 68, thereby forming annular conduit 16 and inner conduit 9. In this embodiment, the isolation tool 30 is connected to the bottom of the concentric coiled tubing 65 by connection means 62 known in the art. The downhole BOP 10 is then connected to the isolation tool 30 by similar connection means 62 known in the art.

The foregoing disclosure and description of the invention are illustrative and explanatory thereof. Various changes in the size, shape and materials as well as the details of the illustrated construction may be made without departing from the spirit of the invention.

What is claimed is:

1. An apparatus for isolating a zone in a hydrocarbon formation for testing flow of hydrocarbons, formation fluids and/or drill cuttings during vertical, horizontal or directional reverse circulation drilling of a wellbore using concentric drill string, said concentric drill string comprising an inner tube having an inner conduit and an outer tube, said inner tube being situated inside the outer tube and forming an annular conduit therebetween, comprising:

(a) an isolation tool comprising a center tube, an outer casing and an expandable and contractible packer means for sealing off an outside annular passage formed between a wall of said wellbore and an outer surface of said concentric drill string, said isolation tool adapted to be operably connected to said concentric drill string such that the isolation tool is in fluid communication with both conduits; and (b) a downhole flow control means having at least one valve means for controlling the flow of hydrocarbons, formation fluids and drill cuttings through the annular conduit, the inner conduit or both and adapted to be operably connected to said concentric drill string such that the downhole flow control means is in fluid communication with both conduits.

2. The apparatus of claim 1 wherein said concentric drill string comprises joints of concentric drill pipe.

3. The apparatus of claim 2 wherein said isolation tool and said downhole flow control means are separated from each other by one or more joints of concentric drill pipe.

4. The apparatus of claim 1 wherein said concentric drill string comprises concentric coiled tubing.

5. The apparatus of claim 1 wherein said downhole flow control means is operably connected to said concentric drill string below said isolation tool.

6. The apparatus of claim 1 wherein said downhole flow control means is operably connected to said concentric drill string above said isolation tool.

7. The apparatus of claim 1 wherein said inner tube is made of a rubber material, rubber and steel, fiberglass or other composite material and comprises electrical wires and said packer means of said isolation tool expands or contracts by means of an electric current delivered by the electrical wires of the inner tube.

8. The apparatus of claim 1 wherein said packer means comprises an inflatable ring.

9. The apparatus of claim 8 wherein said inflatable ring expands or contracts by pumping fluids into or out of the inflatable ring.

10. The apparatus of claim 1 wherein said isolation tool and said downhole flow control means are further adapted to be connected to each other.

11. A method for isolating a zone in a hydrocarbon formation for testing flow of hydrocarbons, formation fluids and/or drill cuttings during vertical, horizontal or directional reverse circulation drilling of a wellbore using concentric drill string, said concentric drill string comprising an inner tube having an inner conduit, and an outer tube, said inner tube being situated inside the outer tube and forming an annular conduit therebetween, comprising:

(a) providing an isolation tool comprising a center tube, an outer casing and a sealing means for sealing off an outside annular passage formed between a wall of said wellbore and an outer surface of said concentric drill string, the isolation tool adapted to be operably connected to said concentric drill string such that the isolation tool is in fluid communication with both conduits;

(b) sealing off the outside annular passage formed between the wall of said wellbore and the outer surface of said concentric drill string;

(c) sealing off one of said conduits of the concentric drill string;

(d) allowing hydrocarbons, formation fluids and/or drill cuttings present in said isolated testing zone to flow through the other of said conduits to the surface of said wellbore; and (e) measuring the amount of hydrocarbons, formation fluids and/or drill cuttings present in said isolated testing zone.

12. The method of claim 11 wherein the sealing means comprises an expandable and contractible packer means.

13. The method of claim 12 wherein said packer means is expanded and contracted by means of an electrical current.

14. The method of claim 12 wherein said packer means is expanded and contracted by means of addition of fluid into or removal of fluid out of the packer means.

15. The method of claim 11 wherein the annular conduit or inner conduit of the concentric drill string is sealed off by means of a downhole flow control means comprising at least one valve means.

16. The method of claim 11 wherein said concentric drill string comprises joints of concentric drill pipe.

17. The method of claim 11 wherein said concentric drill string comprises concentric coiled tubing.

* * * * *